United States Patent [19]

Korwin et al.

[11] Patent Number: 4,662,117

[45] Date of Patent: May 5, 1987

[54] DUST COLLECTING APPARATUS

[75] Inventors: David A. Korwin, Rockford, Ill.; Robert E. Remillard, Janesville, Wis.

[73] Assignee: The Ingersoll Milling Machine Company, Rockford, Ill.

[21] Appl. No.: 778,201

[22] Filed: Sep. 20, 1985

[51] Int. Cl.[4] ..... B24B 55/06

[52] U.S. Cl. ..... 51/5 R; 51/273; 29/DIG. 84

[58] Field of Search ..... 51/5 R, 273, 270; 408/67, 68; 409/137; 29/DIG. 78, DIG. 84, DIG. 86

[56] References Cited

U.S. PATENT DOCUMENTS

| | | | |
|---|---|---|---|
| 1,969,513 | 8/1934 | Kelley | 29/DIG. 86 |
| 2,107,552 | 2/1938 | Smith | 29/DIG. 86 |
| 2,145,939 | 2/1939 | Markley | 29/DIG. 86 |
| 4,563,115 | 1/1986 | Abe et al. | 409/137 |

FOREIGN PATENT DOCUMENTS

| | | | |
|---|---|---|---|
| 1158084 | 12/1983 | Canada | 409/202 |
| 2261297 | 6/1974 | Fed. Rep. of Germany | 51/273 |

*Primary Examiner*—Frederick R. Schmidt
*Assistant Examiner*—Robert A. Rose
*Attorney, Agent, or Firm*—Fitch, Even, Tabin & Flannery

[57] ABSTRACT

The invention contemplates the provision of a double-shelled dust-collecting hood for a high-speed rotary cutting tool. The outer shell seals itself to the workpiece while the inner shell stands clear of the workpiece. The outer shell is open-ended so that the flow of air induced by a suction port within the hood enters at the unsealed end of the outer shell and reverses direction as it turns into the inner shell.

6 Claims, 15 Drawing Figures

FIG. 8
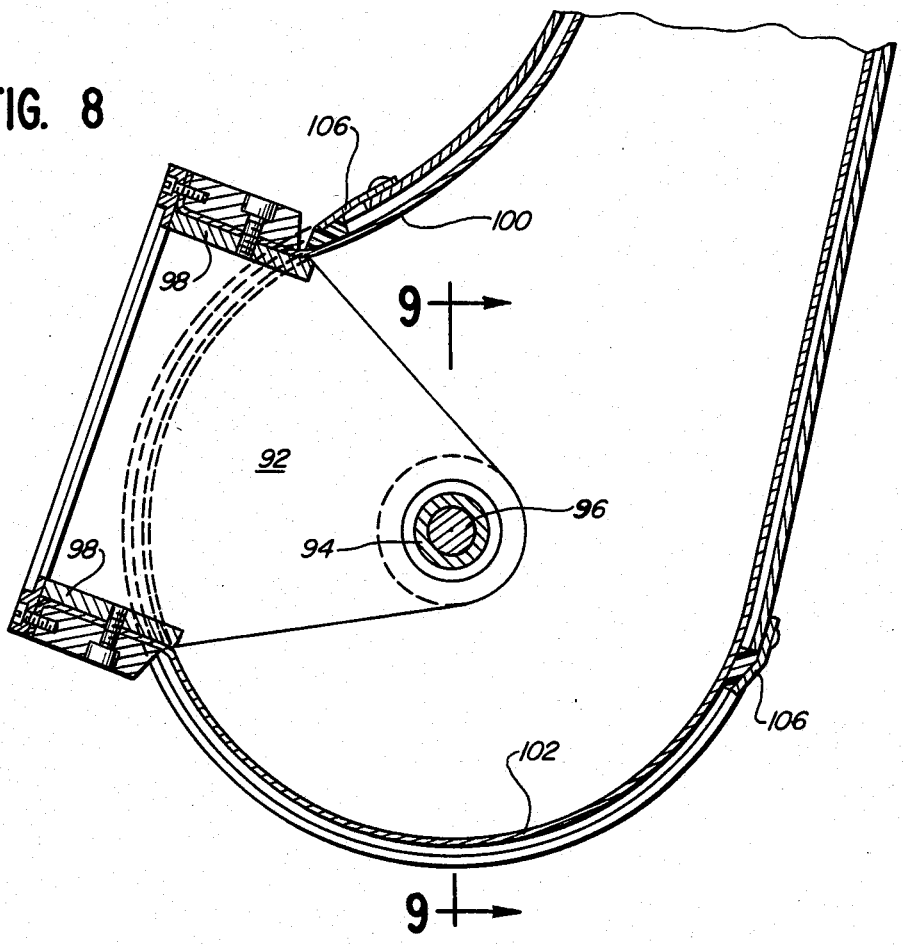
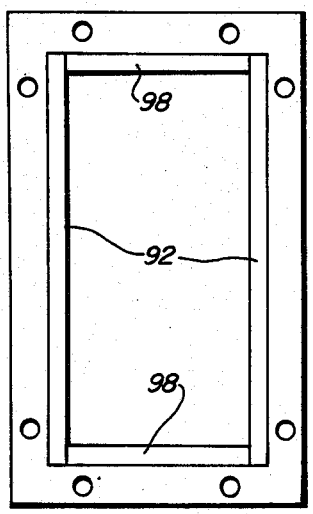
FIG. 8.5
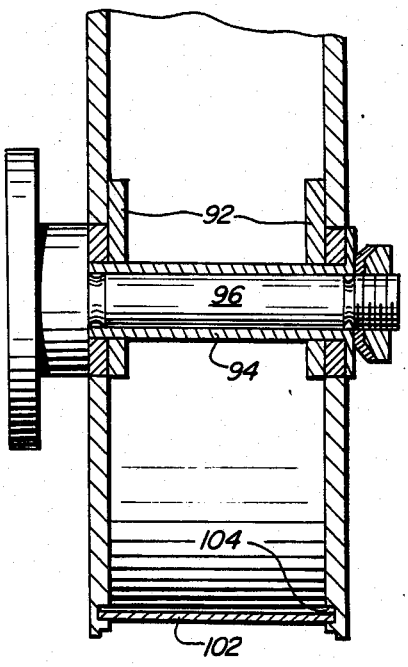
FIG. 9

DUST COLLECTING APPARATUS

This invention involves a system and apparatus for collecting the dust generated by the cutting action of a high-speed power tool, and removing it from the work zone.

BACKGROUND OF THE INVENTION

While the concepts involved in the system and apparatus herein disclosed and claimed are believed to have application beyond the specific field for which they were developed, the invention was made in connection with the machining of the so-called composite materials which are used in substitution for metal as the surfaces and structural components of aircraft.

The composite materials now in use may be fibers in strand form or as woven textiles which are impregnated with or embedded in a matrix of a heat curable thermosetting resin. When constructing sheets or shells, these materials are laid incrementally upon a work surface having the desired final contour of the intended aircraft component, with the embedded fibers oriented in the directions of the principal strength requirements, and with a sufficient number of layers of the impregnated fibrous building elements, usually tapes or webs, to provide the necessary cross-sectional thickness to the component, or even to localized areas thereof.

When the component is laid up, layer upon layer, and subsequently cured, the matrix of this composite structural material is rigidified, and, because it is destined for precision assembly either with other like parts, or with internal framing structure, it must be trimmed precisely to size and also to facilitate assembly.

The cutting methods evolved for the machining of these materials, because of the nature of the material, have departed somewhat from typical metal machining technology employing milling tools having distinct or readily discernible cutting edges, and are built upon high-speed abrasion in which the cutting edges, although discrete, are barely discernible because the cutting particles are small and positioned randomly on the surface of the cutter. A favored material is diamond crystal embedded in a metal coating formed upon the surface of a rotary steel tool.

Analogizing to milling methods and to milling cutters for the sake of this disclosure, the tools employed for edge trimming may be thought of as comparable to end mills, while for dressing or planing sizeable sections of surface, for example, reducing edge thicknesses for joining the composite shells to internal aircraft structure, the analogous milling technique is face milling.

As between the two techniques, face milling by its nature produces large volumes of dust in the form of minute particles of the composite material, fibers and matrix, which must be collected and removed from the machining site and disposed of. The particles vary on average from 0.0002 to 0.003 inches in size when using cutters having abrasive particles of 30 mesh. The particles are relatively light in weight and, when airborne, settle relatively slowly and indiscriminately, creating manufacturing processing problems because the fibrous material rendered particulate in the machining process is typically graphite, whose airborne invasion of adjacent electrical controls can cause a myriad of unintended electrical results, and because the dust can accumulate detrimentally on the way surfaces of the machine, and contaminate the lubrication systems.

It is accordingly the object of this invention to provide an efficient apparatus and system for the expeditious removal of the particulate composite material from the cutting site where it is generated, and transporting it to remote storage for periodic disposal.

SUMMARY OF THE INVENTION

Summarily stated, the invention contemplates the removal of cutting dust by entraining it in a flow of air through a hood or housing surrounding the high-speed cutter, the configuration of the hood so as to provide an advantageously directed flow of air in the hood in opposition to the flow of particles discharged by the cutter, and the entrainment of those particles either by the absorption of their energy in the opposing air stream, or upon their impingement upon the walls of the hood surrounding the cutting site.

BRIEF DESCRIPTION OF THE DRAWINGS

FIGS. 8 and 9 are respectively front and side elevational views of that section of the conduit which accommodates the swiveling of the spindle head in its yoke; and FIGS. lOA, B, C, D and E illustrate respectively typical material cutting conditions encountered.

DETAILED DESCRIPTION OF THE INVENTION

The Overall Machine

Figure 1:
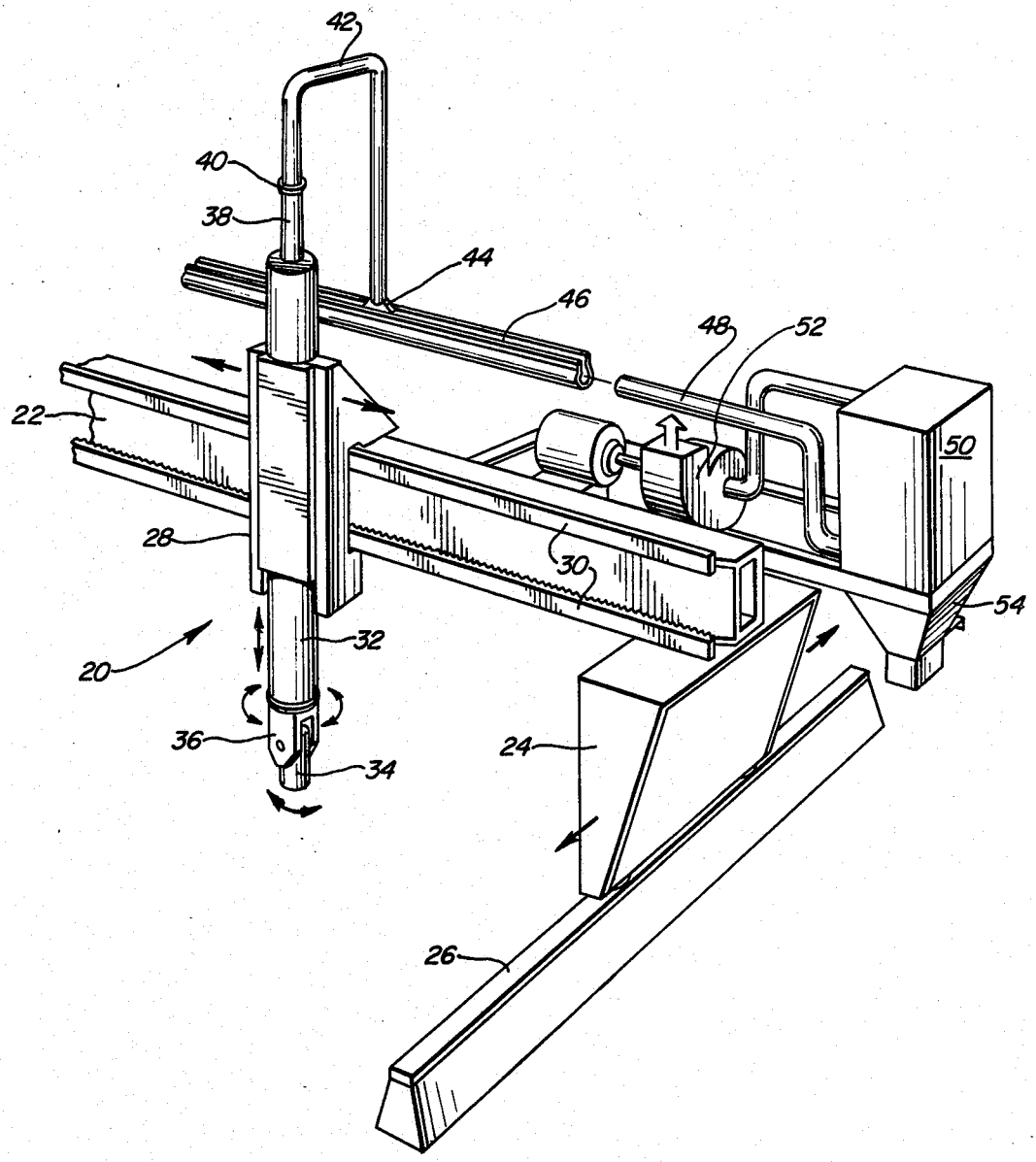
FIG. 1 is a fragmentary isometric view of a five-axis gantry-type milling machine in connection with which the invention was developed.
Figure 2:
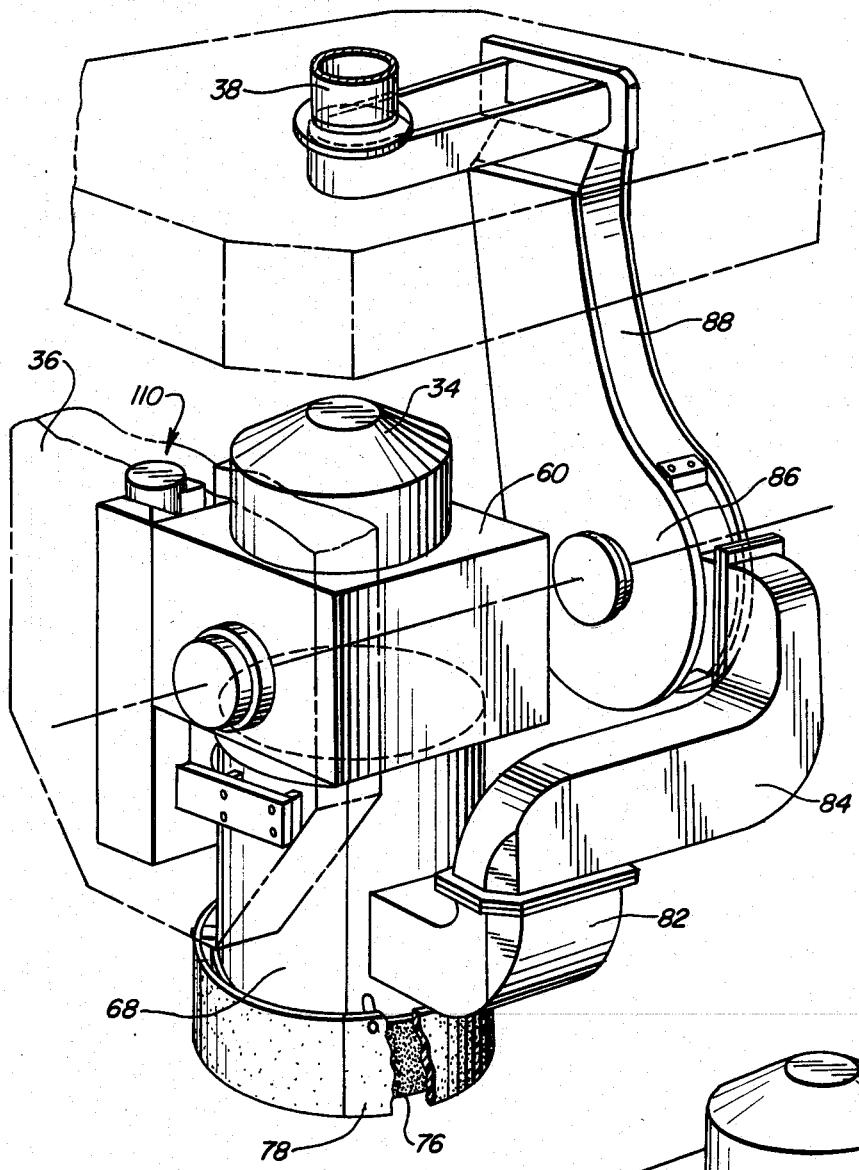
FIGS. 2 and 3 are isometric views of the spindle yoke from opposite sides, showing the collecting hood attached to the spindle head, as well as the exhaust conduit in the immediate vicinity of the spindle.
Figure 3:
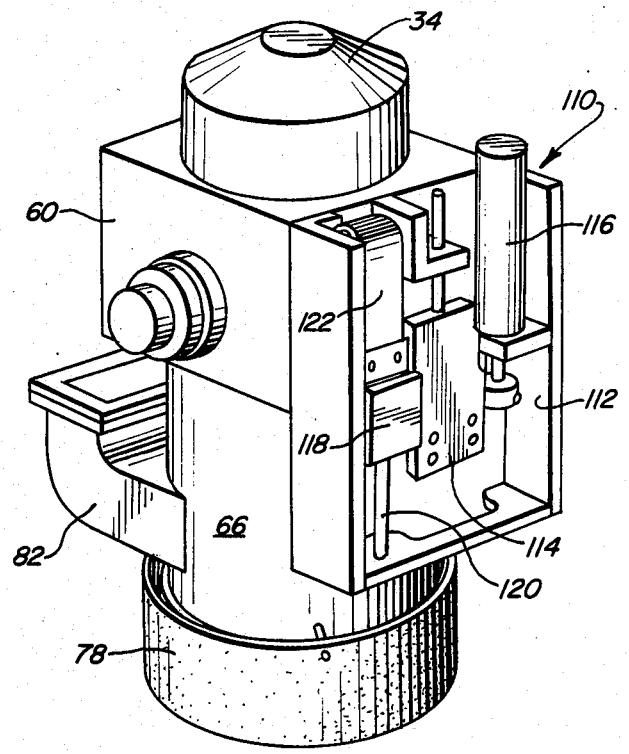

The illustrative machine setting is a gantry-type milling machine 20, having a cross rail 22 spanning the work area between two column-like structures 24, only one of which is shown, and which are movable along ways 26 in a direction transverse to the axis of the cross rail and typically referred to as the "X-axis" of the machine.

The milling head comprises a saddle 28 movable along ways 30 on the cross rail, i.e., in the direction of the axis in the cross rail, commonly referred to as the "Y-axis" of the machine, having slideably mounted therein a vertically movable ram 32 whose longitudinal axis is the "Z-axis" of the machine, and, at the lower end of the ram, a gimbal-mounted spindle head 34. The gimbal action is provided by the swivel mounting of the spindle head in a yoke or fork 36 at the bottom of the ram, i.e., on the so-called "B-axis" of the machine, and by the swiveling of the yoke about the vertical axis of the ram, viz., the "C-axis" of the machine.

Machine movement along or about each of its five axes is accomplished by screws, gearing, or other positive drive powered by servo motors under computerized numerical control, as has become conventional for certain machine tools.

Because FIG. 1 is too small in scale to depict the detail of the dust collector associated with the spindle head 34, that description is reserved for reference to subsequent drawings, but the overall suction apparatus which removes the dust entrained by the air flow in the hood at the spindle head, because of its larger scale, is readily discernible from FIG. 1.

In particular, the dust generated at the spindle is conveyed by means yet to be described to a conduit 38 rising through the center of the ram and having a telescopic joint 40 with the coaxial portion of a cross-over conduit 42 which extends rearwardly from the saddle, being supported rigidly therefrom by framing which is not shown, and descends at the back of the saddle to a narrow shoe 44 which is slideable between the normally closed and flexibly conforming lips of a slide header 46 having its axis parallel to that of the cross rail and being supported thereon by framing not shown. At its end nearest the cross-rail end illustrated, the slide header 46 is connected coaxially to a horizontal conduit 48 which then descends vertically to the entry port at the bottom of a filter housing 50 of conventional design, containing numerous elongated bag filters sustained against the air flow by interior wire mesh framing or the like, and communicating at their open upper ends with a plenum in the top of the housing. The flow of air is thence conducted to the intake of a centrifugal fan 52 supported with its drive motor and the filter housing upon shelf-like framing secured to the back of the cross rail.

For this service, the centrifugal fan selected provides 1,100 standard cubic feet per minute maximum when driven by a motor rated 15 horsepower at 3,600 rpm.

In the kind of filter described, i.e., suspended cloth bags maintained fully expanded by an inner frame, the dust collects as a cake on the outside of the bags from which it is periodically removed by pressurizing the plenum above the bags, the caked dust falling to the gated hopper bottom 54 of the filter housing from which it is periodically loaded into an appropriate container for disposal.

The elements of the suction system, namely, the telescopic joint 40 above the ram, the slide header 46, the bag filter 50, and the centrifugal fan 52 are of conventional design which does not enter as such into the present invention.

The Spindle Mount

Referring to FIGS. 2 to 6 for a closer look at the gimbal-mounted spindle 34, the gimbal mounting, as earlier noted, is provided by the yoke 36 which depends from the ram and is rotatable about the vertical or "C-axis" of the machine. Journaled in the arms of the yoke by means of protruding trunnions is a cradle frame 60 in which a spindle head 34 is secured to support the spindle for limited rotation about a horizontal axis through the gimbal yoke, i.e., about the "B-axis" of the machine. The spindle proper (not shown) is driven by a self-contained high-speed, totally enclosed and liquid cooled DC motor over a speed range of from 5,000 to 25,000 rpm. The spindle coolant lines, hydraulic lines, and electrical service lines are omitted from the drawings for clearer illustration of the dust collecting apparatus of the invention, with which they have no direct relation.

Figure 4:
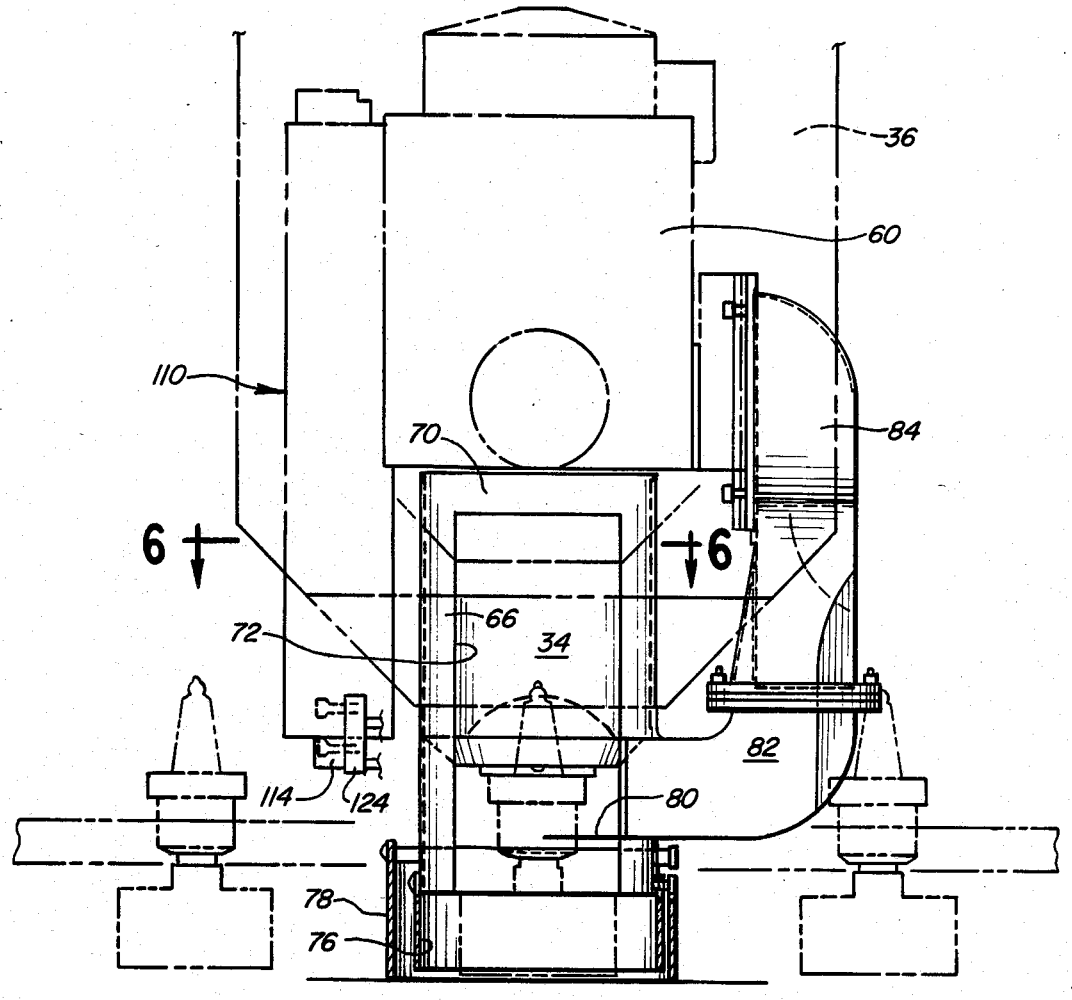
FIG. 4 is an elevational view of the spindle head and hood with the access door removed.
Figure 5:
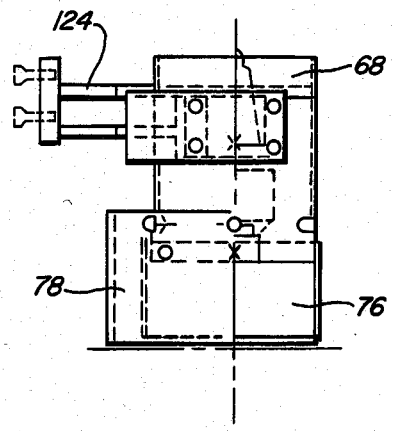
FIG. 5 is an elevational view of the access door isolated from the hood.
Figure 6:
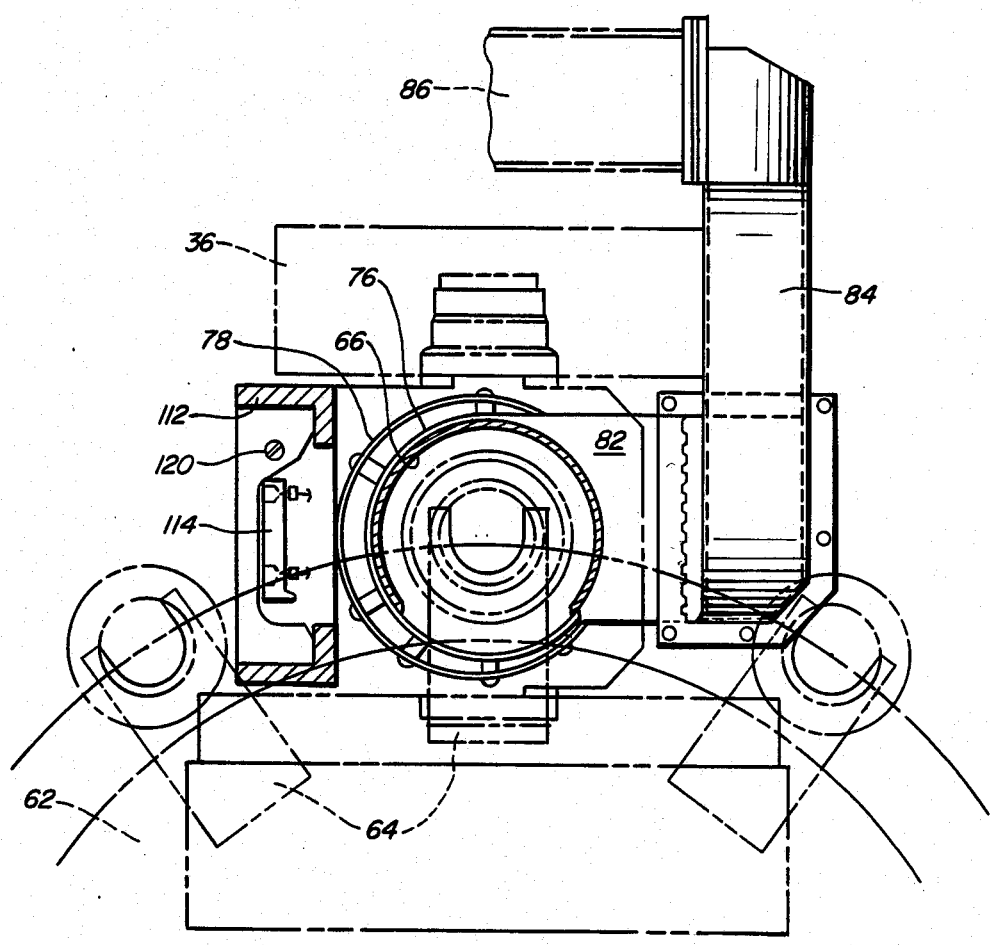
FIG. 6 is a plan view, partly in section, of the dust collecting hood attached to the spindle head and illustrating the relation of the spindle with the tool magazine when changing tools.

The spindle itself is provided with a conventional tool gripper, not shown, hydraulically operated for the automatic tool change indicated schematically by FIGS. 4 and 6. The tool magazine takes the form of a rotary plate 62 suspended from the gantry cross rail at one end thereof so as to index the tool holders 64 of the magazine selectively into the axis of the ram, which lowers the tool held in the spindle, moves it laterally into the fork of the tool holder, and releases the tool, retreating and returning to the magazine after the appropriate tool has been indexed into place, to regrip and remove the new tool.

The Dust Collector

The dust collecting housing is removably attached to the cylindrical spindle head as an extension thereof.

It comprises a stainless steel tubular hood 66 slipped over the spindle head up to the swivel cradle 60 and slit at its upper end on the side opposite an access door 68 to provide a clamping band 70 above the door opening 72. Blocks welded to the outside of the hood adjacent the slit receive a slit-spanning screw 74 (FIG. 6) which is tightened to exert a girdling force which holds the hood in place on the spindle head.

Attached to the tubular hood 66 at its lower end is a tubular skirt 76 of polyurethane sheet which surrounds the working zone of the tool, providing a curtain which serves to direct the air flow and as a target for the impingement of particulate matter of such mass that it is not entrained before reaching the housing walls. Also secured to the hood at its lower end is a shell-like, open-ended surrounding outer skirt 78 of the same polyurethane sheet material which is suspended from the hood 66 in spaced relation thereto and to the inner skirt 76, so as to provide an air channel between them. The outer skirt is mounted to the hood by means of screws received in spacer blocks welded to the outside surface of the hood while the inner skirt is screwed directly to the outer surface of the hood as an extension thereof.

The previously-mentioned access door 68 is constructed as a sector of the cylindrical shell of the hood and carries similar skirt sectors at its lower end, attached to the metal shell of the door in the same fashion. When the tool is to be changed, the door is moved upwardly by a vertical sliding motion, being supported independently of the hood, and actuated by mechanism later to be described. This opens the hood along one side upwardly from the bottom edges of the skirts for a sufficient distance to permit the door opening to straddle a tool holder 64 of the tool magazine. However, when lowered into place for operation, the door completes the metal shell of the hood and the respective cylindrical skirts which depend from it as lower extensions.

The polyurethane sheet material of which the skirts are formed is resiliently deformable, having a thickness of $\frac{1}{8}$ inch and a hardness of 70A Durometer to permit the same to yield to conform to the contours of the workpiece. In their upper bands, where they are screwed to the metal shell of the hood, the urethane skirts are densified to 70D Durometer to rigidify the bands at the point of attachment and to preserve their cylindrical shape.

As the depending skirts serve the multiple functions of directing the flow of air into the housing as well as absorbing the energy of the high-velocity particles of greater mass, they have a preferred relationship to each other and to the tool whose action generates the dust to be collected.

Referring to FIG. 4, the opening provided by the inner skirt 76 at the bottom of the hood, with the door 68 closed for operation, is a generally planar opening, the plane of which is preferably penetrated by the tip of the tool to a depth of approximately ⅛ inches. The surrounding outer skirt 78, on the other hand, is longer than the inner skirt so as to extend a comparable distance beyond the tip of the tool so that when the spindle and tool are lowered into cutting relationship to the work, the outer skirt 78 will seal itself to any work surface which is larger than the lateral dimensions of the hood itself, as is typically the case when face milling. Depending upon the depth of cut taken, the inner skirt may or may not touch the workpiece but will, in any event, be free of the workpiece in the path created by the tool.

The Spindle Mounted Suction System

On one side of the collector hood 66 adjacent the spindle head, i.e., remote from its downwardly open end, is an evacuation port 80 (FIG. 4) which communicates through intermediate conduit and the filter housing 50 with the suction side of the centrifugal blower 52 carried by the overhead cross rail.

The evacuation port occupies approximately a third of the circumference of the cylindrical hood, being connected to a conforming conduit 82 of rectangular cross section which is welded to the wall of the hood. That conduit is formed with an upturning elbow after which it is connected at a gasketed flange joint to a transverse double-bent conduit section 84 which conveys the air stream laterally beyond the spindle yoke, where it communicates with a rotary union 86 mounted coaxially with the spindle cradle. At the top of the riser 88 from the rotary union, the air stream is directed back to the "C-axis" from which the air passes upwardly through the conduit 38 within the ram to the telescopic joint 40 seen in FIG. 1, and thence by means already described to the filter housing and to the centrifugal fan which induces the pressure head.

The rotary union 86, shown in detail in FIGS. 8, 8.5 and 9, is formed by providing the side walls of the riser conduit 88 with a circular outline centered upon the pivot axis of the spindle cradle, and omitting the circumferential end walls thereof. In lieu thereof, a swiveling radial conduit 90 (FIGS. 8.5 and 9) flanged to mate with the twice-bent transverse conduit section 84 which delivers the air stream from the hood, is formed as a rotary frame comprising a pair of segmental side plates 92 joined by a bushing 94 mounted on a stub axle 96 coaxial with the spindle pivot, and by a pair of connecting plates 98 which complete the radial conduit of the union. A pair of separate flexible steel tapes 100 and 102 secured to the radial conduit 90, with their side edges emplaced within circular grooves 104 milled in the side plates of the riser, constitute the circumferential walls of the union and are sealed by wiping blades 106 where the riser conduit departs tangentially from the circular union. Thus, as the spindle is swiveled within the gimbal yoke, the radial conduit 90 of the rotary union is free to swivel through the same arc, pushing and pulling the flexible steel tapes 100 and 102, respectively, which constitute the peripheral walls of the rotary union.

It will be obvious, of course, that this arrangement is not airtight, but the leakage represented by the rotary union and other joints of the conduit system is compensated by providing a pump of adequate capacity, the entrained particulate matter being maintained within the system in any event by the reduced pressure within.

The Door Operator

The access door 68, as earlier indicated, is constructed as a sector of the metal shell of the hood 66, having sectors of the inner and outer skirts 76 and 78 attached thereto so as to complete the periphery of the skirts and hood when the door is in place.

The door 68 is raised and lowered by an actuating mechanism 110 mounted to the spindle cradle 60 on the side of the hood opposite the evacuation port 80. It comprises a flat box frame 112 having the lateral dimension of the spindle cradle and extending downwardly to the depth of the spindle head (FIG. 4). Centered within the frame is a slide block 114 supported on one side by a single-acting air cylinder 116, the piston rod of which is attached to the slide block at one lower edge, and at its other side by a slide bearing 118 mounted on a vertical guide rod 120 secured at top and bottom to the frame.

The reel of a constant-force spring 122 is journaled in the frame above the guide rod 120 with its tape secured to the slide bearing, tending to raise the slide block 114 and, through its connections to the door 68, to open the door.

Figure 7:
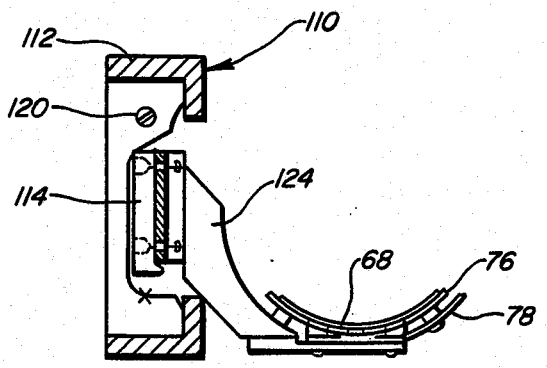
FIG. 7 is a plan view of the access door.

Those connections (FIGS. 5 and 7) consist of a corner bracket 124 secured both to the slide block and to the door and shaped to reach around the hood from the slide block to the door, which is displaced 90 degrees from its actuator. That bracket consists of two mounting flanges attachable respectively to the slide block 114 and to supporting posts provided on the metal shell of the door, connected together by a pair of spaced arcuate horizontal arms welded to each of the backets.

The combination of the constant force spring 122 acting in one direction, and the single-acting air cylinder 116 acting in the opposite direction, is intended to maintain the door 68 normally open to prevent inadvertent damage thereto, and to simplify the overall controls by automatically opening the door whenever electrical or air power is lost or shut down. However, sensing switches (not shown) are provided to indicate whether the door is closed or open.

Operation

When the outer skirt 78 is sealed to the surface of the workpiece, as in face milling, the air flow induced into the housing by the suction system enters through the circumferential space between the hood 66 and the outer skirt 78, and enters the interior of the hood only after making an inward turn around the bottom of the inner skirt 76. The radially inward and reversing turn of the air flow path into the plane of the debris issuing tangentially from the cutter, and generally opposite to the direction of the flow of that debris, absorbs much of the energy of the particulate stream and entrains the dust as the air moves upwardly through the housing. The larger and heavier particles which do not spend their energy completely against the incoming air stream impinge upon the walls of the inner and outer skirts 76 and 78 and are swept up by the flow of air which passes between them and enters the hood at the bottom of the inner skirt.

It will be observed from FIGS. 4 and 6 that the outer skirt 78, although cylindrical, is not concentric with the hood 66 and inner skirt 76, but is offset away from the evacuation port 80 of the hood. The greater throttling effect of the closer spacing of the skirts on the side of the evacuation port tends to balance the flow of air into the hood from all directions to accept the heavy particulate flow from the high-speed tool from any direction.

The direction of flow of the cutting dust will vary with the direction of rotation of the reversible spindle, the tool cutting equally well in either direction, and with the direction of the feed, i.e., whether climb cutting or conventional, and also with the changing direction of feed, as, for example, when the cutter is making the trim cut around the periphery of the workpiece.

Typical cuts encountered in the service for which the hood of the invention was designed are depicted in FIGS. 10A to 10E, inclusive, each of which is a sectional view of the deformable inner and outer skirts 76 and 78 taken on the axis of the tool and transverse to the direction of feed, i.e., as though the tool were oncoming.

Figure 10A:
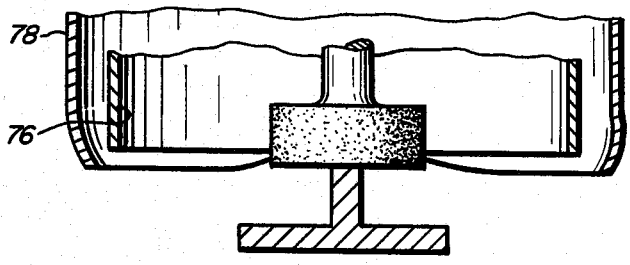

FIG. 10A illustrates the edge planing of the upstanding web of a T-section which might be encountered, for example, as a reinforcing rib co-cured as part of a larger sheet or shell.

Figure 10B:
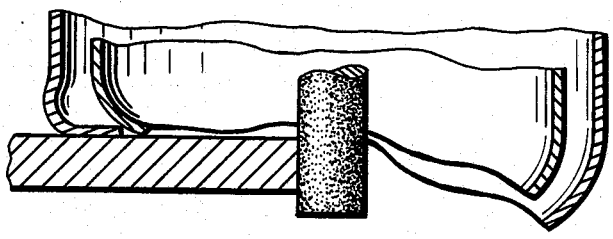

FIG. 10B illustrates the edge trimming of a sheet or shell by an end milling type of operation.

Figure 10C:
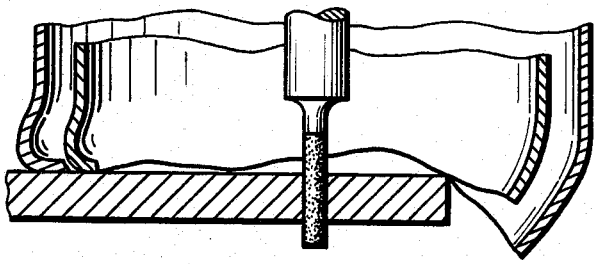

FIG. 10C illustrates a form of "sawing", i.e., the use of an end mill of reduced diameter for a slot-cutting pass to remove trim waste in bulk without converting it all to dust.

Figure 10D:
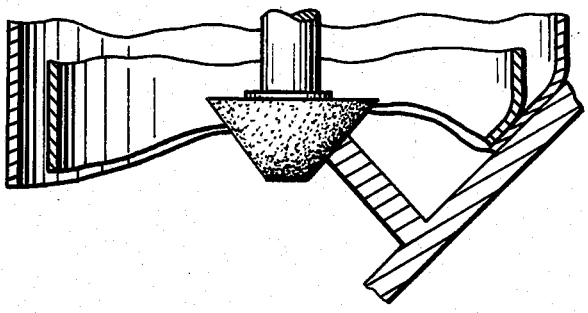

FIG. 10D illustrates a slant-axis cut such as might be used to cut a curved depression in an upstanding reinforcing web.

Figure 10E:
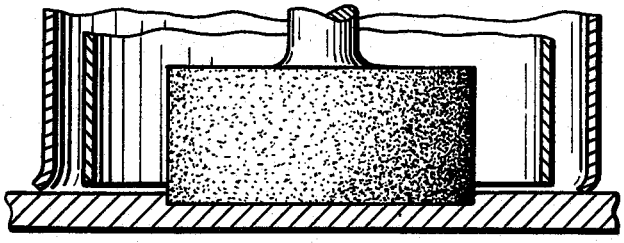

FIG. 10E illustrates the most severe duty, i.e., the high dust-load face milling operation in which significant amounts of material are removed and all of it converted to dust.

The special air flow inducing function of the outer shell 78 can be appreciated from FIG. 10E. The outer skirt 78 is sealed to the surface of the workpiece while the inner skirt 76 remains above it. In this mode, the induced air stream enters the top of the circumferential space between the two skirts, flows radially inwardly around the elevated bottom of the inner skirt 76 before making its way to the evacuation port 80 of the hood. In making the radially inward turn, the air stream directly opposes the flow of hot dust issuing tangentially from the cutter, irrespective of the direction of its feeding movement, and entrains the dust either directly or after its impingement upon the inner skirt from which it necessarily falls into the inward and upward stream of air.

For the relatively lighter duty represented by the edge-trimming cutting modes of FIGS. 10A to 10D, inclusive, varying portions of the bottom of the hood are open to the atmosphere, permitting a direct inward flow of air with only relatively small flow induced through the outer shell. However, the very substantial amounts of air drawn in under these lower-head, lower-velocity conditions, provides a very high air-to-dust ratio due to the reduced amount of material being removed, with the result that the lesser amounts of dust created in such trim operations are efficiently removed.

The dust collector herein described has proved to be very effective not only for the lighter dust loads occasioned by edge trimming and the like, but especially for the collection and removal of dust generated in large volume by face milling.

The features of the invention believed responsible for the improved dust collection observed are set forth in the following claims.

What is claimed is:

1. An air flow system for collecting and continuously removing dust generated by the high-speed cutting of composite material or the like, comprising a spindle head supported upon a frame adapted to position the same in spaced relation to a workpiece, said spindle head supporting a high-speed spindle, a tubular housing extending from the spindle head so as to enshroud a cutting tool held in said spindle, said housing having a planar opening at its end remote from the spindle head and having an evacuation port remote from said open end, the walls of said housing at said open end terminating short of the tip end of the tool mounted in the spindle, an open-ended outer shell surrounding said housing in spaced relation thereto and having a flexibly and resiliently deformable skirt terminating outwardly of the tip of said tool in a plane parallel to the open end of said housing, said outer shell when placed in sealing contact with a workpiece forming an air intake channel with said housing for the flow of air drawn from said housing at the evacuation port, the arrangement directing the flow of air between the housing and the shell toward the open end of the housing and thence inwardly toward said port to intercept and entrain the dust particles cast at the housing walls and said shell by the rotation of the tool.

2. The system of claim 1 wherein the tubular housing and the surrounding outer shell are cylindrical, the open end of the housing is formed by a resiliently deformable skirt within the skirt of the outer shell, the evacuation port is disposed in a side wall of the cylindrical housing, the housing is coaxial with the spindle, and the axis of the outer shell is offset from the spindle axis toward the side of the housing opposite the evacuation port.

3. The system of claim 2 wherein said housing is provided with an access door comprising respectively a sector of said housing, said shell and said skirts, respectively, and a door operating mechanism fixed with respect to said spindle head and supporting said door for endwise movement axially of the housing and toward the spindle head to provide radial access into the housing for changing the tool.

4. In combination with a five-axis milling machine having a high-speed spindle adapted for cutting composite materials such as are employed as the surface shells of aircraft, said machine including a saddle movably mounted on a cross rail spanning the work surface and having mounted thereon a vertically slideable ram with a gimbal-mounted spindle head at the lower end thereof, an air flow system for collecting and continuously removing dust generated by the high-speed cutting action comprising a tubular housing extending from the spindle head so as to enshroud a cutting tool held in said spindle, said housing having a planar opening at its end remote from the spindle head and having an evacuation port remote from said open end, the walls of said housing at said open end terminating short of the tip end of a tool mounted in the spindle, an open-ended outer shell surrounding said housing in spaced relation thereto and having a flexibly and resiliently deformable skirt terminating outwardly of the tip of said tool in a plane parallel to the open end of said housing, said outer shell when placed in sealing contact with a workpiece forming an air intake channel with said housing for the flow of air drawn from said housing at the evacuation port, the arrangement directing the flow of air between the housing and the shell toward the open end of the housing and thence inwardly toward said port to intercept and entrain the dust particles cast at the housing walls and said shell by the rotation of the tool, and flexible conduit means connecting said evacuation port with a suction pump through an intermediate filter to separate the entrained dust from the flow of air induced by said pump.

5. The combination of claim 4 wherein the tubular housing and the surrounding outer shell are cylindrical, the open end of the housing is formed by a resiliently deformable skirt within the skirt of the outer shell, the evacuation port is disposed in a side wall of the cylindrical housing, the housing is coaxial with the spindle, and the axis of the outer shell is offset from the spindle axis toward the side of the housing opposite the evacuation port.

6. The combination of claim 5 wherein said housing is provided with an access door comprising respectively a sector of said housing, said shell and said skirts, respectively, and a door operating mechanism fixed with respect to said spindle head and supporting said door for endwise movement axially of the housing and toward the spindle head to provide radial access into the housing for changing the tool.

* * * * *